US005743059A

United States Patent [19]

Fifield

[11] Patent Number: 5,743,059

[45] Date of Patent: Apr. 28, 1998

[54] ROOF TILE

[75] Inventor: John Alfred Fifield, Buckinghamshire, England

[73] Assignee: CRH Oldcastle, Inc., Los Angeles, Calif.

[21] Appl. No.: 334,497

[22] Filed: Nov. 4, 1994

[30] Foreign Application Priority Data

Nov. 5, 1993 [GB] United Kingdom ..... 9322805

[51] Int. Cl.[6] ..... E04D 1/16

[52] U.S. Cl. ..... 52/519; 52/536; 52/748.1; 52/746.11; 52/535; 52/539

[58] Field of Search ..... 52/519, 526, 528, 52/536, 539, 554, 745.2, 746.11, 747.11, 748.1, 535

[56] References Cited

U.S. PATENT DOCUMENTS

| | | | |
|---|---|---|---|
| 773,230 | 10/1904 | Seested | 52/535 |
| 4,696,451 | 9/1987 | Mansfield | 52/748.1 X |
| 4,729,202 | 3/1988 | Ferland | 52/536 X |
| 4,758,148 | 7/1988 | Jidell . | |
| 4,890,432 | 1/1990 | Shepherd | 52/535 X |
| 4,925,383 | 5/1990 | Jidell . | |
| 4,932,184 | 6/1990 | Waller | 52/535 |
| 5,004,415 | 4/1991 | Schulz et al. . | |
| 5,048,255 | 9/1991 | Gonzales | 52/535 X |
| 5,060,444 | 10/1991 | Paquette | 52/535 |
| 5,174,092 | 12/1992 | Naden | 52/519 X |
| 5,323,581 | 6/1994 | Jakel | 52/519 |
| 5,406,766 | 4/1995 | Nicholas et al. | 52/554 X |

FOREIGN PATENT DOCUMENTS

| | | |
|---|---|---|
| 0475471 | 3/1992 | European Pat. Off. . |
| 644099 | 10/1950 | United Kingdom . |
| 2128656 | 5/1984 | United Kingdom . |
| 2200930 | 8/1988 | United Kingdom . |
| WO 93/12918 | 7/1993 | United Kingdom . |

*Primary Examiner*—Wynn E. Wood
*Attorney, Agent, or Firm*—Panitch Schwarze Jacobs & Nadel, P.C.

[57] ABSTRACT

An extruded roof tile (30) has an upper surface (11), which is contoured to give the appearance of a profiled tile and which is, for example, provided by projections (32, 34) extending between the upper and lower edges (13) and (14*a*) respectively of the tile, and an under surface (12) having a shape which is other than a contoured shape which generally follows that of the upper surface (11) of the tile (30). For example, the under surface (12) may have a shape which corresponds to that of a flat tile. In one method of making the tile (30), a material from which the tiles (30) are made is extruded onto a path which shapes the under surface (12) of tiles (30), the material is compressed to provide the upper surface (11) of tiles (30) with a contoured shape, for example provided by the projections (32) and (34), the under surface (12) of tiles (30) is provided with a shape which is other than a contoured shape which generally follows that of the upper surface (11) of tiles (30) and the contoured appearance of the upper surface (11) of tiles (30) is changed without changing the shape of the under surface (12) of tiles (30).

16 Claims, 9 Drawing Sheets

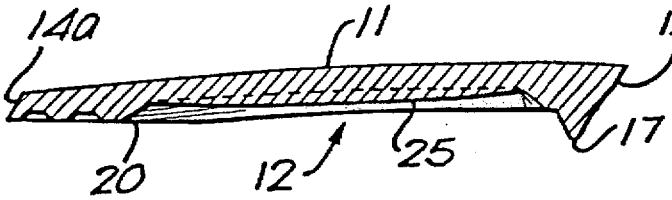
FIG. 1f PRIOR ART
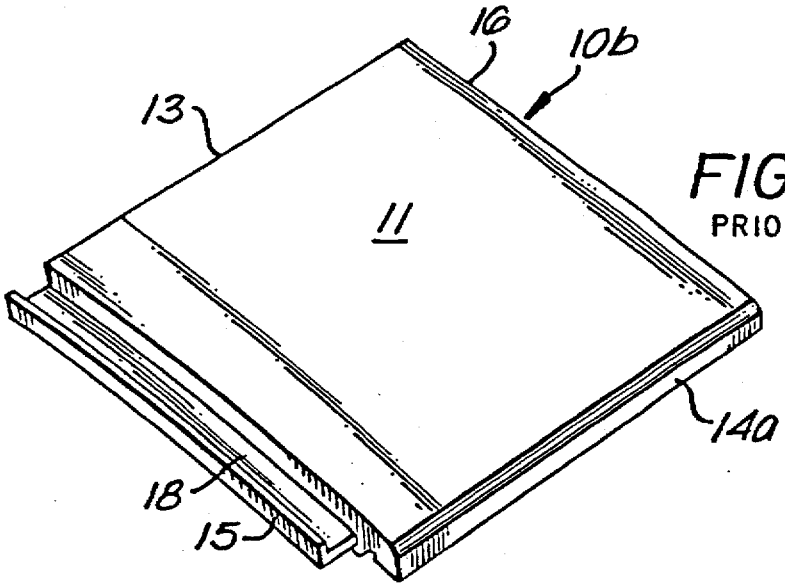
FIG. 1e PRIOR ART
FIG. 1g PRIOR ART
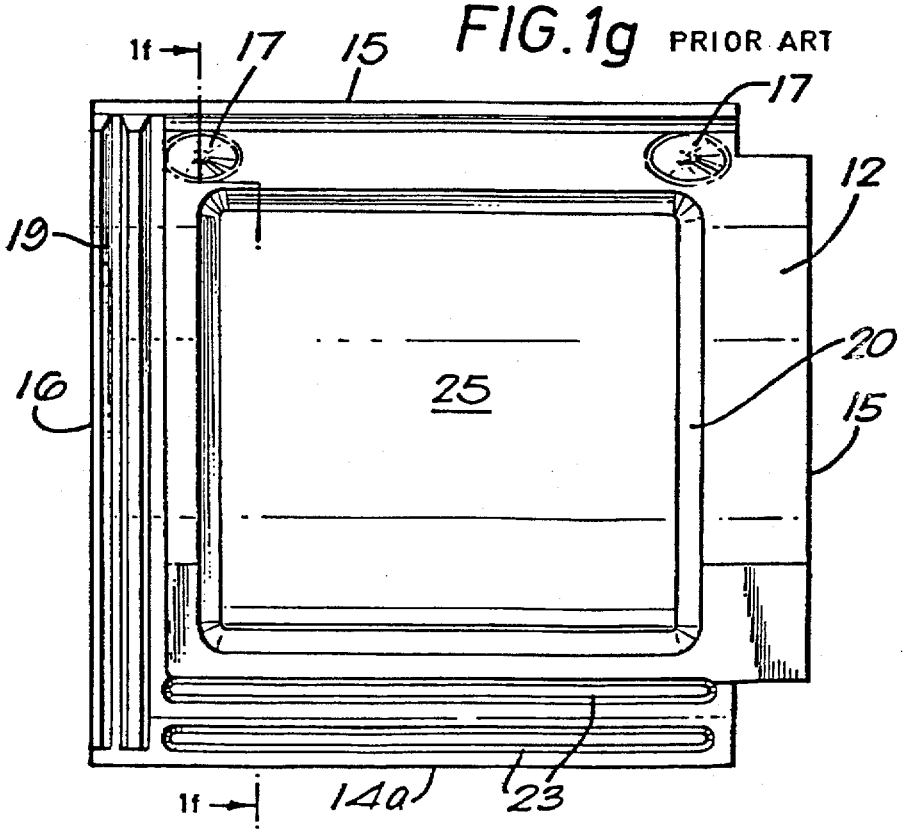

ROOF TILE

BACKGROUND OF THE INVENTION

The present invention relates to extruded products such as roof tiles and cladding tiles, and more particularly to extruded concrete and clay roof and cladding tiles.

Roof tiles and the like are made in many different shapes and shades. The most widely sold tiles tend to be relatively simple, are of generally uniform thickness and have a generally flat geometry with a substantially flat or cambered upper surface in use, with the lower surface in use having a shape which generally follows that of the upper surface, such tiles being hereinafter generically referred to for convenience as "flat" tiles. Examples of such flat tiles are so-called plain tiles and "slates." The popularity of flat tiles is due not only to the fact that they are easy to manufacture and hence relatively inexpensive, but also because they are very flexible in laying, for example, they can be laid in either straight or broken bond patterns to create different visual effects. These flat tiles can be made by extrusion, by molding or by pressing.

By contrast, tiles which are profiled, that is tiles which when laid provide an undulating or otherwise substantially non-planar roof surface, are less adaptable in laying and also are generally more costly to produce owing to the fact that each profile requires its own special tooling since the underside of a profiled tile usually follows the general contours of the upper surface of the tile. Profiled tiles can also be made by extrusion, molding or pressing.

Manufacture by molding or by pressing is generally much less efficient than extrusion with the result that there is a preference within the industry to adopt extrusion processes whenever possible.

The production of roof tiles by extrusion has been known for many years. Extruded concrete roof tiles are generally made from a cementitious mixture including sand and/or other aggregate, cement, coloring pigment and water plus optionally one or more other additives to facilitate extrusion, prevent growth of fungus, etc. The extrusion apparatus usually comprises a hopper-like box which is disposed above a conveyor path and which is charged with the cementitious mixture. The flow of the cementitious mixture is assisted in the box by means of a rotating paddle disposed within the box. A succession of pallets for molding the under surface of the tiles is driven along the conveyor path and beneath the box so that the cementitious mixture forms on the pallets and is compressed therein by means of a rotating roller disposed within the box upstream of the paddle and having a contour which corresponds to the upper surface of the tiles to be formed.

The cementitious mixture is further compressed on the pallets as they pass out of the box by means of a slipper which is disposed downstream of the roller and also has a contour which corresponds to that of the upper surface of the tile to form a continuous extruded ribbon of cementitious mixture on the pallets. The ribbon is subsequently cut into tile forming lengths downstream of the box by means of a suitable cutting knife and the pallets with the formed tiles thereon are conveyed to a curing location. At the curing location, the tiles are conveyed through a curing chamber which is maintained at a high relative humidity and temperature. The curing time is usually in excess of 6 hours. The tiles undergo only a partial curing in the curing chamber from whence they are conveyed to, and stacked out of doors, to complete the curing process.

In order to produce a new shape of profiled tile by extrusion it has, hitherto, generally been necessary to provide new tooling, for example, in the form of new dies and pallets. Tooling costs for new profiles are estimated to be as much as £300,000 or more for each new shape. This means that a manufacturer needs to be confident of substantial sales in a new profile before investing in new tooling. The expense of new tooling has therefore acted as a disincentive to the introduction of new ranges of profiled tiles.

A further drawback associated with profiled tiles is the requirement for custom components for affixing the tiles to their associated supporting structures. This need for specific components also adds to costs which ultimately are passed on to the customer.

Of course, the launch of any new product presents financial risks to the manufacturer, not only in terms of tooling but also in marketing costs. As far as possible, it is necessary therefore to ensure that sales of the product will be sufficient to recoup any investment. The aforementioned disadvantages have consequently deterred manufacturers from launching new shapes of profiled tiles.

SUMMARY OF THE INVENTION

The applicant has therefore identified a need for a profiled roof or cladding tile which offers flexibility in laying and does not require customized components, yet also has a low entry cost in terms of tooling.

Accordingly, from one aspect, the invention relates to an extruded roof tile having a contoured upper surface in use, characterized in that the upper surface comprises an extrusion face which is contoured to give the appearance of a profiled tile and the under surface in use has a shape which is other than a contoured shape which generally follows that of the upper surface of the tile.

More particularly, this aspect is directed to an extruded roof tile comprising an upper edge, a lower edge and opposed side edges when in an orientation as installed on a roof, and having an under surface and a contoured upper surface, the upper surface comprising an extrusion face having a shape to give the appearance of a profiled tile, including a contoured portion and a portion which is not contoured, and the under surface having a shape which generally corresponds to the shape of the portion of the upper surface of the tile that is not contoured.

From another aspect, the present invention resides in a method of making extruded roof tiles, wherein a material from which the tiles are made is extruded onto a path which shapes the under surface in use of the tiles and is compressed to shape the upper surface in use of the tiles, characterized in that the upper surface of the tiles is provided with a contoured shape to give the appearance of a profiled tile and the under surface of the tiles is provided with a shape which is other than a contoured shape which generally follows that of the upper surface of the tiles.

More particularly, this method is directed to a method of making extruded roof tiles comprising an upper edge, a lower edge and opposed side edges when in an orientation as installed on a roof, and having an under surface and a contoured upper surface, the upper surface having a shape to give the appearance of profiled tiles, including a contoured portion and a portion which is not contoured, and the under surface having a shape which generally corresponds to the shape of the portion of the upper surface of the tile that is not contoured, the method comprising the steps: (a) extruding a material from which the tiles are made onto a path which shapes the under surface of the tile; and (b) compressing the material on the path to provide the tiles with the contoured upper surface and with the under surface.

The shape of the under surface of tiles made in accordance with the invention to be of a shape that does not follow that of the upper surface of the tile is preferably what could be described as of generally flat geometry which includes tiles with a camber extending between the upper (i.e., trailing) and lower (i.e., leading) edges and/or between the side edges. Such cambered tiles, when considered in cross-section taken along a line extending between the side edges are substantially flat. There are tiles on the market which fulfill these criteria and which have been previously defined herein as "flat" tiles.

Therefore, the invention also relates to an extruded roof tile having a contoured upper surface in use, characterized in that the upper surface of the tile comprises an extrusion face which is contoured to give the appearance of a profiled tile and the under surface in use has a shape which corresponds to that of a flat tile as hereinbefore defined. The invention also relates to a method of making an extruded roof tile which is characterized by being provided with an under surface in use which corresponds to that of a flat roof tile and an upper, extrusion face which corresponds to that of a profiled tile.

By means of the present invention, it is possible to produce tiles having the appearance in use of conventional profiled tiles, yet which retain the advantages of flat tiles in that they can be laid in both straight or broken bond patterns.

Other significant advantages of the present invention are that new profiles can be produced merely by changing or adapting whatever means are used to compress the tile making material, typically dies constituted by roller and slipper means, such as at least one roller followed by a slipper, to produce the desired upper surface profile, there being no necessity to create new pallets for shaping the under surface in use of the tile, and there is no need for customized components for affixing the tiles to the supporting roof structure.

Accordingly, from a further aspect, the present invention resides in a method of making extruded roof tiles wherein a material from which the tiles are to be made is extruded onto a path which shapes the under surface in use of the tiles and is compressed to shape the upper surface of the tiles, characterized in that the upper surface of the tiles is provided with a contoured shape to give the appearance of a profiled tile and the under surface of the tiles is provided with a shape which is other than a contoured shape which generally follows that of the upper surface of the tiles, and in that the contoured appearance of the upper surface of the tiles is changed without changing the shape of the under surface of the tiles.

More particularly regarding this aspect of changing the upper surface shape of the tiles, the present invention is directed to a method of making at least two series of extruded roof tiles, each tile comprising an upper edge, a lower edge and opposed side edges when in an orientation as installed on a roof, and having an under surface and a contoured upper surface, the upper surface having a shape to give the appearance of a profiled tile, including a contoured portion and a portion which is not contoured, each series of tiles having a different upper surface shape, and the under surface of all series having a shape which generally corresponds to the shape of the portion of the upper surface of the tile that is not contoured, the under surface of the tiles of all series having substantially the same shape, the method comprising the steps: (a) extruding a material from which the tiles are made onto a path which shapes the under surface of the tiles; and (b) compressing the material on the path to provide each series of tiles with a different contoured upper surface without changing the under surface shaped on the path.

Thus, the under surface of the tiles remains the same as in flat tiles while the upper surface can be subjected to contour variations such as to produce many different shapes of profiled tiles. Moreover, when the path comprises a plurality of pallets supported by a conveyor, the same pallets can be used for all the variations in shape of the contoured upper surface.

From a still further aspect, the invention resides in a method of making a tile wherein a tile making material is extruded onto a path for shaping the under surface in use of the tiles and the tile making material is compressed to produce on each tile a contoured upper surface, characterized in that the contoured upper surface comprises at least one continuous projection extending along the upper surface of the tile between the upper and lower edges of the tile and by removing that part of the or each continuous projection which lies in the overlap region of the tile when in use.

The material of the or each projection in the overlap area may be removed in any convenient way, e.g., by mounting a suitable means such as a scoop, adjacent the conveyor path on which the extruded tiles have been severed from the extruded ribbon or on which the extruded ribbon is moving whereby movement of the scoop into the path of movement taken by the projection on the moving tile or ribbon causes removal of a sufficient amount of material from the projection to provide the requisite overlap. Preferably, the scoop is mounted downstream of the extrusion head and is automatically rotated about a substantially horizontal axis into and out of a position in which the projection material is removed.

The absence of projections in the overlap region means that each tile is largely independent of an adjacent tile such that it is possible to create a tiled roof structure from any number of different tiles according to the invention. In other words, a mixture of tiles can be used each having a different profile on its upper surface. Thus it is possible to create all manner of aesthetic effects, for example, in the form of a random selection of different tiles or a geometric arrangement. Of course, further aesthetic effects can be achieved by using tiles of different colors.

The invention further relates to a pitched roof structure comprising a roof laid with any of the roof tiles defined hereinabove.

In one form of such pitched roof structure, the tiles are laid with their upper and lower edges in overlapping relationship and with the projections of adjacent tiles in side by side relationship in abutment.

BRIEF DESCRIPTION OF THE DRAWINGS

In order that the invention may be more readily understood, reference will now be made to the accompanying drawings, in which:

FIG. 1*e* is a perspective view from above of yet another form of an extruded flat roof tile known as an interlocking slate in the prior art;

FIG. 1*f* is a cross-section taken along the line 1*f*—1*f* of FIG. 1*g*.

FIG. 1*g* is an underneath plan view to an increased scale of the tile of FIG. 1*e* and of the tile of FIG. 2.

In the drawings, the same reference characters are used to designate the same or similar parts.

DETAILED DESCRIPTION OF THE PREFERRED EMBODIMENTS

Figure 1A:
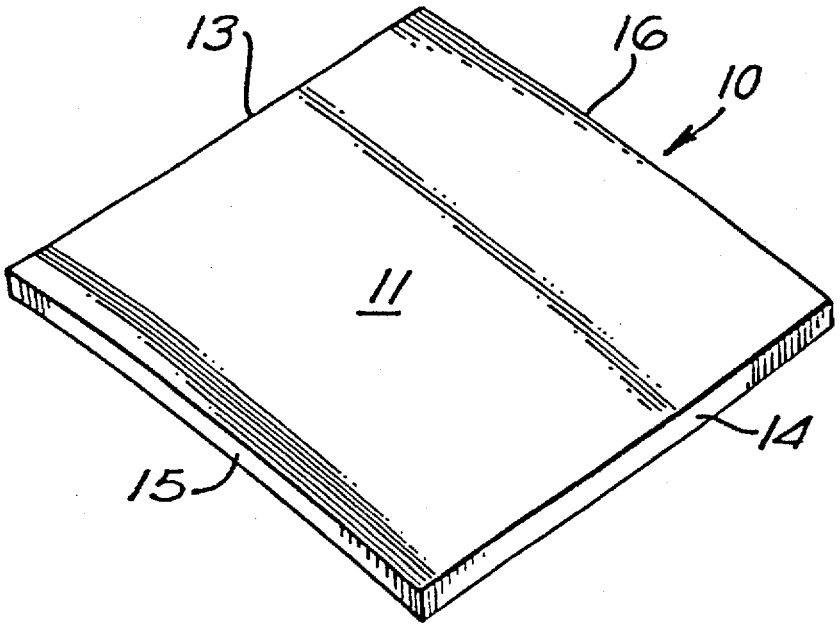
FIG. 1a PRIOR ART
FIGS. 1*a* and 1*b* are perspective views from above and below, respectively, of one form of extruded flat roof tile, known as a plain tile in the prior art.

The tile according to the invention is preferably generally rectangular in plan view. Thus, advantageously, the tile is provided on at least one pair of opposite side edges with means for cooperating with adjacent tiles. The cooperating means may be of any convenient form, for example in the form of overlapping means, more especially in the form of an interlocking means comprising an underlock and an overlock extending along opposite sides respectively of the tile. Such tiles are known as interlocking tiles.

Within the context of the under surface of the tile having a shape which is the generally flat geometry of a flat tile, the under surface may be provided with formations, such as shallow channels, recesses and the like to improve air flow and to facilitate drainage of any ingressed water, and/or with ridges, projections, convexities and the like to provide reinforcement and/or act as rain barriers. The tile under surface may also be provided with one or more locating projections, for example, in the form of nibs, which are used to locate the tile in position on the roof battens.

Unlike a conventional flat tile, however, the upper surface of the tile according to the invention has the appearance of a profiled tile. In this regard, the contouring of the upper surface conveniently takes the form of one or more formations in the form of projections and/or depressions. Preferably, the contouring comprises at least one projection which stands proud of (i.e., extends outwardly from) the general plane of the tile.

The or each formation provided on the upper surface of the tile may be in the form of a discrete projection and/or depression, but more preferably is in the form of a continuous projection and/or depression running generally between the upper and lower edges and/or between the side edges in use. In a particularly preferred embodiment, the or each formation is in the form of one or more continuous projections running from the headlap region of the upper edge of the tile, i.e., from a sufficient distance from the upper edge of the tile to permit the tiles to be laid in overlapping relationship to form a roof. In the case where the formations are depressions, these may, if desired, extend all the way from the upper edge to the lower edge of the tile because they will not prevent overlapping.

The number of different profiled tiles which can be produced in accordance with the invention is virtually limitless, and the cost of producing a new profile is substantially reduced as compared to previous methods where it has been necessary to provide both new rollers and slippers and new pallets, and often customized components as well.

As previously described, the formations provided on the upper surface of the tiles are preferably in the form of projections which lie above the general plane of the tile. These projections may be located centrally on the upper surface or may be positioned adjacent to one or more side edges or in any position in between. In a particularly preferred embodiment, projections are provided adjacent each side edge of the tile such that when two tiles are laid side by side, the projections abut against each other, thereby giving the appearance of a continuous formation.

With interlocking roof tiles, one of the projections will be closely adjacent the relevant side edge whereas the other projection will be disposed between the other side edge and the underlock. Moreover, sideways extending projections and depressions on interlocking tiles, stop short of the underlock, i.e., do not extend over or into the underlock.

The adjacent projections of those tiles which are adjacent and abut against one another in side by side relationship when laid to form a pitched roof may together form many different shapes, for example, when viewed in cross-section or in end view, each "pair" of abutting projections may be of hemispherical, triangular, generally rectangular, castellated rectangular, scalloped rectangular, sinuous rectangular or any other suitable shape. Each pair of abutting projections on two adjacent laid tiles respectively, may be mirror images of each other, i.e., the abutting projections are symmetrically disposed about the plane of abutment. This facilitates stacking of those tiles with projections which are of triangular or hemispherical shape when considered in cross-section but gives rise to a line which runs down the middle of each pair of abutting projections on the laid roof. Although such a line is not very noticeable or unsightly, in certain instances, the aesthetic appearance of the roof may be considered to be improved, for example with the generally rectangular shaped projections, by making the abutting projections on the respective abutting tiles asymmetrical, thereby offsetting the plane of abutment so that the line which runs down the projections on the laid tiles is also offset which can have the effect of making each line less visible from the ground. When one or more projections are provided on the upper surface of the tile, the position of the or each projection is preferably chosen to permit easy stacking of the tiles prior to their use. The tiles may be stacked with each of the tiles facing the same direction or alternate tiles may be stacked upside down in order to reduce the risk of any projections being damaged.

Generally, roof tiles and the like are laid in successive rows on a supporting structure such that the lower or so-called leading edge of a tile in one row overlaps the upper or so-called trailing edge of one or more tiles in an adjacent, lower row. Thus, as previously mentioned, the overlap region of the upper surface of the tile in the region of its upper edge is left free from any projections. Accordingly, when the formation on the upper surface of the tile is in the form of one or more continuous projections, this may be achieved by removing that part of the or each projection which lies in the overlap region during or after extrusion.

In order to improve the appearance of a roof comprising tiles of the present invention, the leading edge, that is the lower edge in use, of each tile is preferably tapered. When viewed from below, this gives the impression that the tiles are relatively thin and provide an aesthetically acceptable lower edge. However, away from the leading edge, the tile may be as thick as is necessary or may be provided with suitable reinforcement to give the required strength.

A number of methods may be employed in order to create a tapered leading edge as described above, for example, by shaping the pallets used to form the underside of each tile in such a way as to produce a tapered edge. Alternatively, and more preferably, the taper may be produced using cutting means at an appropriate stage in the production cycle.

Specific presently preferred embodiments will now be described.

Figure 1B:
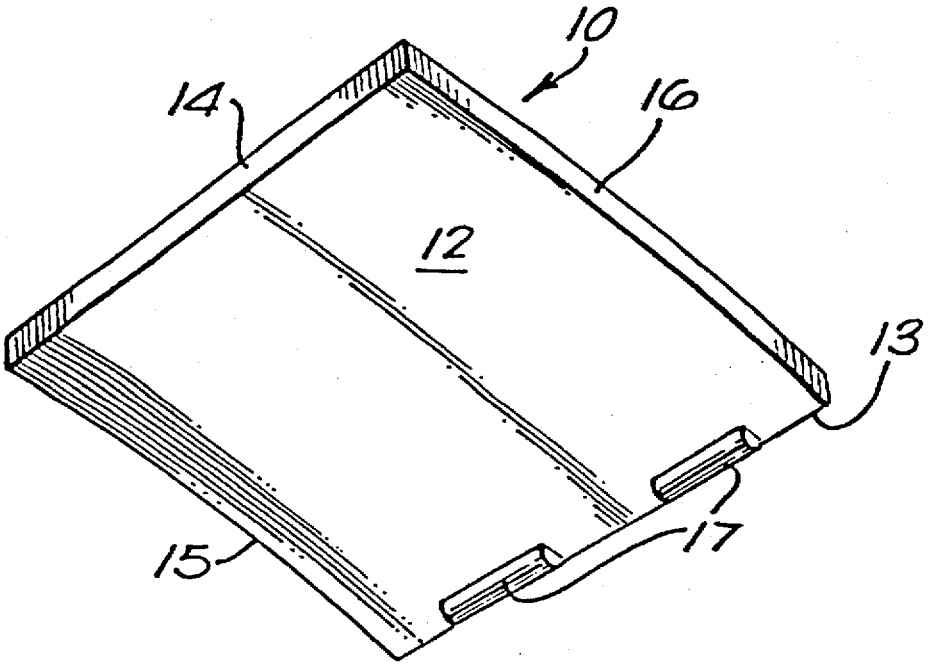
FIG. 1b PRIOR ART

Referring firstly to FIGS. 1*a* and 1*b*, there is shown a generally rectangular plain tile 10 of substantially uniform thickness. The plain tile 10 has a slightly cambered upper surface 11, and under surface 12 having a shape which generally follows that of the upper surface 11, an upper edge 13, a lower (leading) edge 14 and oppositely facing side edges 15 and 16. On the under surface 12, adjacent the upper edge 13, are hanging nibs 17. Such plain tiles can be laid in courses one above the other to form a roof with the tiles of the respective courses being in lower edge to upper edge and side edge to side edge overlapping relationship. The tiles must be laid in a broken bond pattern in which the side edges of the tiles of the respective courses are out of alignment, i.e., staggered as, if laid in a straight bond pattern when the side edges of the tiles of respective courses are in alignment, water would penetrate into the roof space between the aligned tile side edges.

Figure 1C:
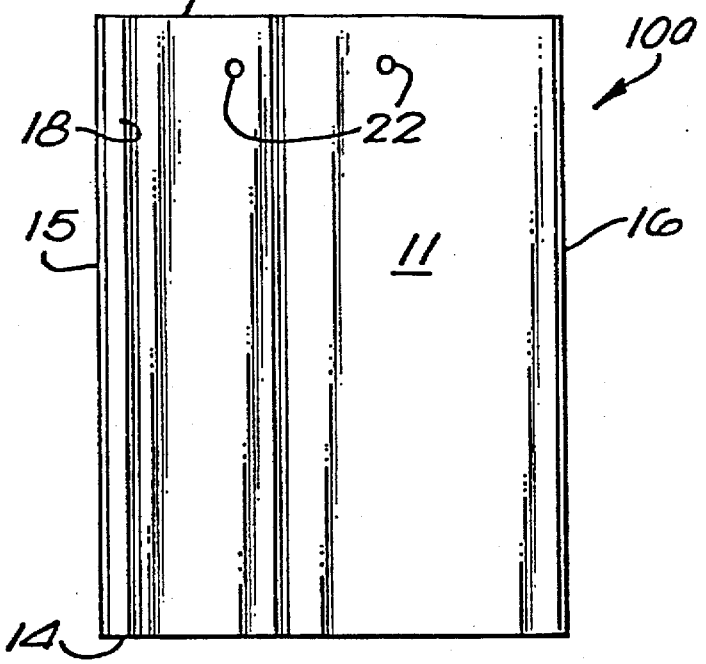
FIG. 1c PRIOR ART
FIGS. 1*c* and 1*d* are top and underneath plan views, respectively, of another form of extruded roof tile known as an interlocking shake in the prior art.
Figure 1D:
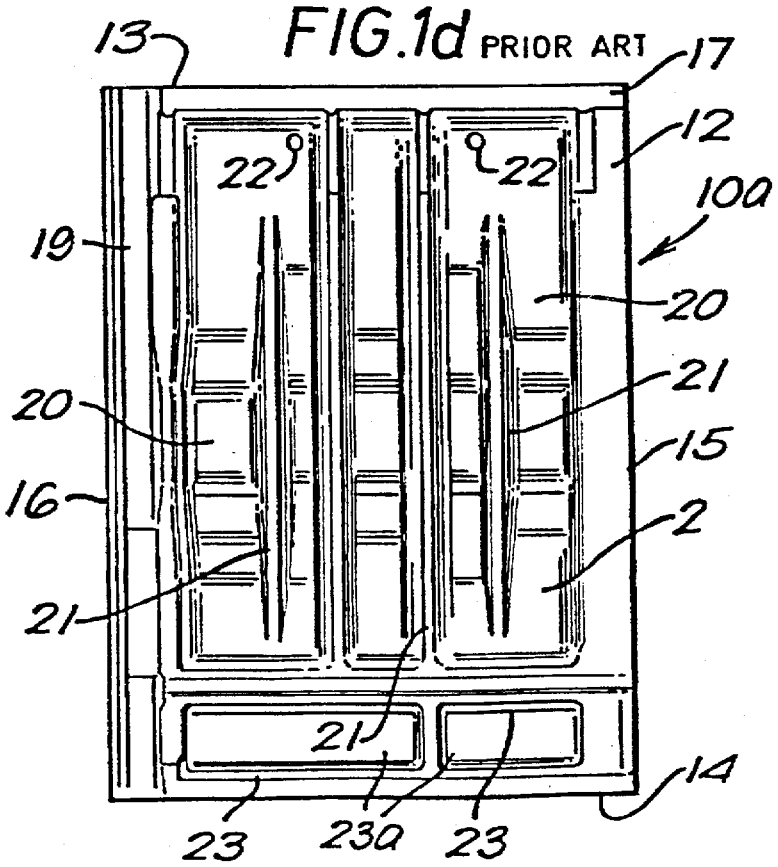
FIG. 1d PRIOR ART

The shake 10*a* shown in FIGS. 1*c* and 1*d* differs from the plain tile of FIGS. 1*a* and 1*b* in that it is an interlocking tile which can be laid in both straight and broken bond patterns and has a flat upper surface 11 with an underlock 18 extending along the side edge 15 and an under surface 12 which is of generally flat geometry and has an overlock 19 extending along the opposite side edge 16 of the tile 10*a*. Additionally, the under surface 12 is provided with recessed portion 20 with reinforcing ridges 21 extending lengthwise of the tile, a single hanging nib 17 and nail holes 22 adjacent the upper edge 13, and transverse ridges 23 adjacent the lower edge 14 serving as rain barriers. The channels 23*a* formed by the rain barriers 23 allow drainage of any rainwater which might penetrate the under surface of the tile during windy conditions.

When tiles 10*a* of the same course are laid adjacent one another to form a roof, the underlock 18 of one tile cooperates with the overlock 19 on the adjacent tile.

Referring to FIGS. 1*e* to 1*f*, there is shown a slate which is generally indicated at 10*b* and which differs from the plain tile 10 in being interlocking like the tile 10*a* of FIGS. 1*c* and 1*d* and having a tapered leading edge 14*a*. Additionally, the recessed portion 20 in the under surface 12 is "bellied out" to produce a reinforcing convexity 25. Also, the slate 10*b* can be laid in both straight and broken bond.

Figure 1H:
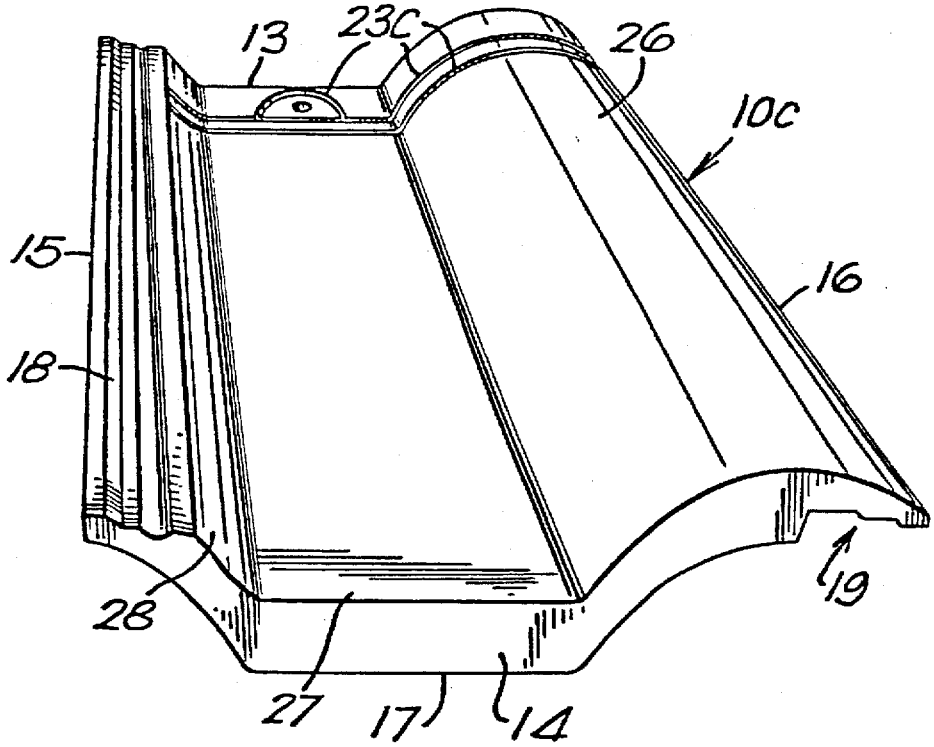
FIG. 1h PRIOR ART
FIG. 1*h* is a perspective view from above of a known extruded profiled tile.
Figure 1I:
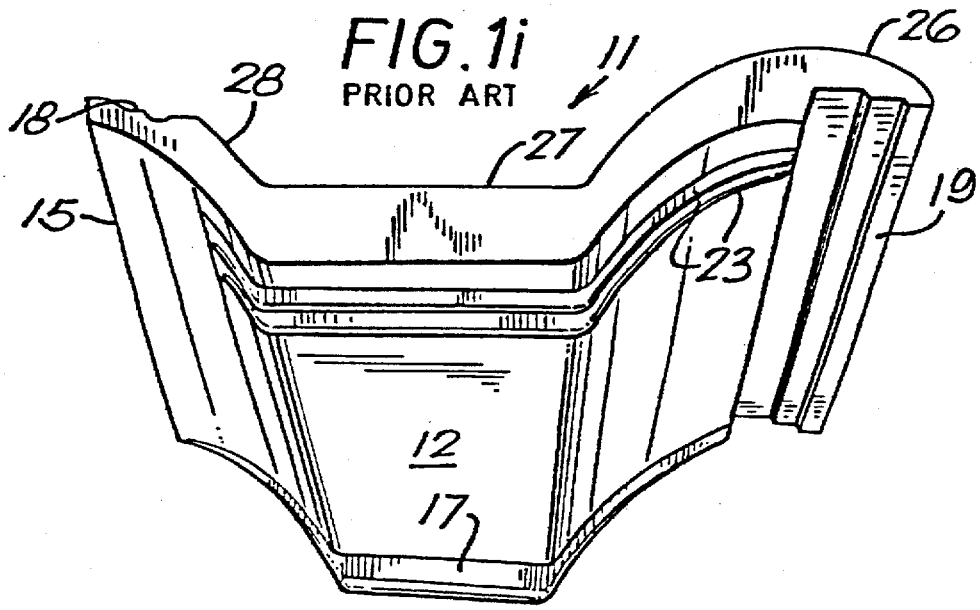
FIG. 1i PRIOR ART
FIG. 1*i* is a perspective view from below of the profiled tile of FIG. 1*h;*

As will be apparent from a comparison of the flat tiles 10*a*, 10*b* and 10*c*, the profiled roof tile 10*c* shown in FIGS. 1*h* and 1*i* has a contoured upper surface 11 formed by a projection constituted by a larger roll portion 26 which extends from the upper edge 13 to the lower edge 14 of the tile and a pan 27, and by a smaller roll portion 28 on the opposite side of the pan 27. The under surface 12 is also contoured and follows generally the contoured shape of the upper surface 11. The contoured tile has cooperating underlocks and overlooks 18 and 19 respectively, a hanging nib 17 and rain barriers 23 on the under surface 12, and rain check grooves 23*c* in the upper surface 11 adjacent the upper edge 13. When the tiles are laid in side to side edge and lower to upper edge relationship, the underlock 18 on the roll portion 26 on one profiled tile 10*c* cooperates with the overlock 19 on the roll portion 28 of another adjacent tile 10*c* so that the two roll portions 26 and 28 of adjacent tiles 10*c* form a continuous roll and the rain barriers 23 of one tile 10*c* of an upper course of tiles cooperate with the rain check grooves 23*a* of another tile 10*c* of the next adjacent lower course with which the tile of the upper course is in overlapping relationship. As will be appreciated, such profiled tiles can only be laid in a straight bond pattern.

Figure 2:
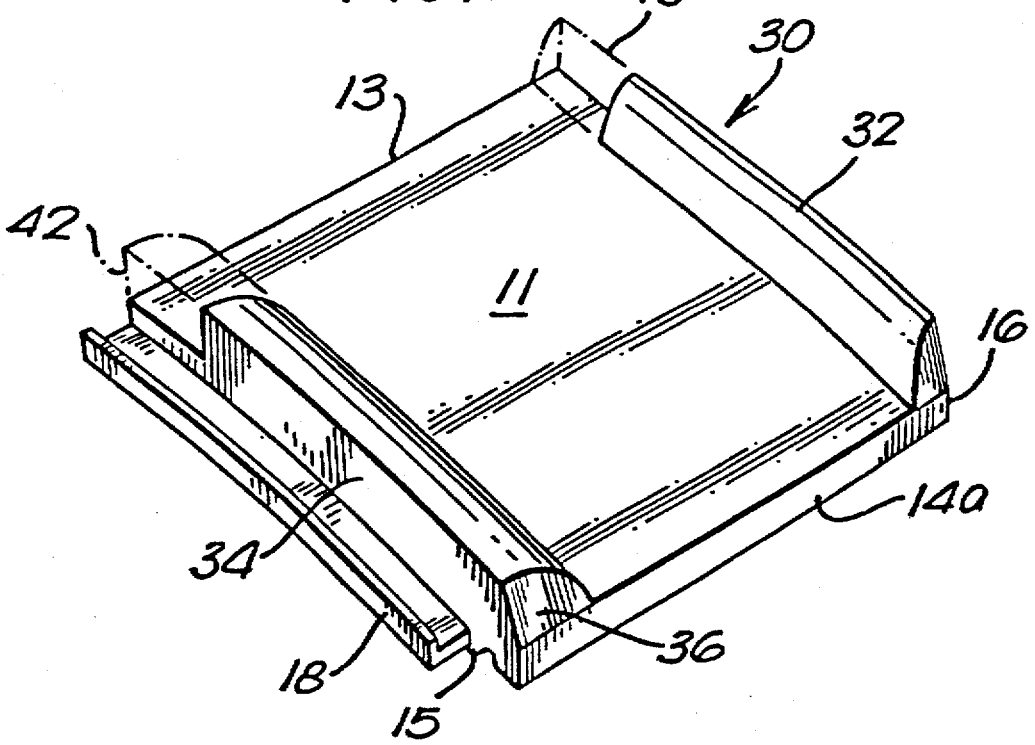
FIG. 2 is a similar perspective view to that of FIG. 1*e* of a roof tile made in accordance with one embodiment of the present invention.

Referring to FIG. 2 taken in conjunction with FIG. 1*g*, FIG. 2 shows an extruded tile 30 in accordance with one embodiment of the invention. In common with the prior art tiles 10*a*, 10*b* and 10*c* previously described, tile 30 has an underlock 18 along one side edge 15 and an overlock 19 (FIG. 1*g*) on the opposite side edge 16. Unlike the prior art tiles 10, 10*a* and 10*b* however, the present tile 30 is provided on its upper surface at opposite side edges with arcuate projections 32, 34 of which one projection 34 has a greater arcuate extent than the other projection 32. These arcuate projections 32, 34 are produced during extrusion of the tile by means of a roller and a slipper which have corresponding arcuate-shaped cut-outs. In particular, as the cementitious mixture from which the tile is formed is extruded onto pallets which are used to shape the under surface of the tile, the mixture is then compressed by means of the cut-out roller and slipper. The resulting extruded ribbon is thereby provided with continuous arcuate projections adjacent each side edge.

Figure 2A:
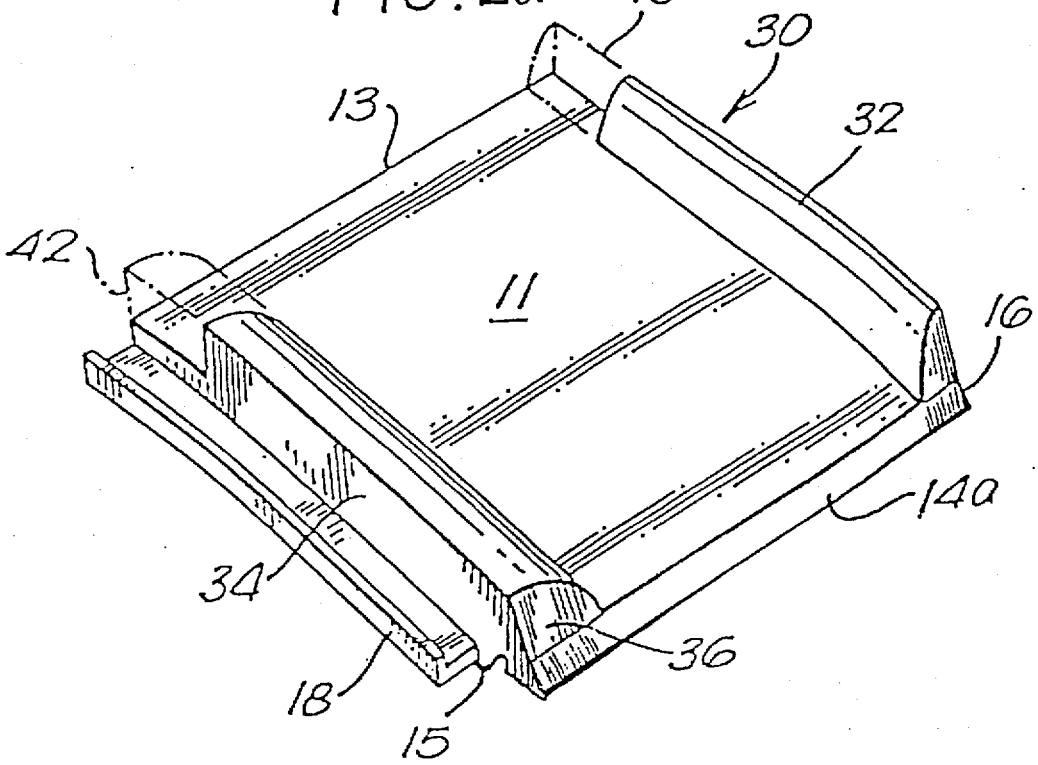
FIG. 2*a* is a perspective view of a roof tile similar to that of FIG. 2 in which the lower edge is tapered.

Downstream of the cut-out roller and slipper, the extruded ribbon is cut with a cutting knife into lengths corresponding to the length of the pallets. Two further cuts are then made, first to provide a tapered lower or leading edge 14*a* of the tile as best illustrated in FIG. 2*a*, and second, to remove those parts 40, 42 (shown by broken lines) of the projections 32 and 34 respectively, which in use would lie under, and be overlapped by the lower or leading edge or edges 14*a* of a similar tile or tiles 30 in an adjacent row. Similarly, a lower edge portion 36 of projection 34 may also be angled or tapered, as illustrated in FIGS. 2 and 2*a*. The projection 32 along the opposite side of the tile likewise may have a tapered or angled lower edge portion, as also illustrated in FIGS. 2 and 2*a*.

Figure 3:
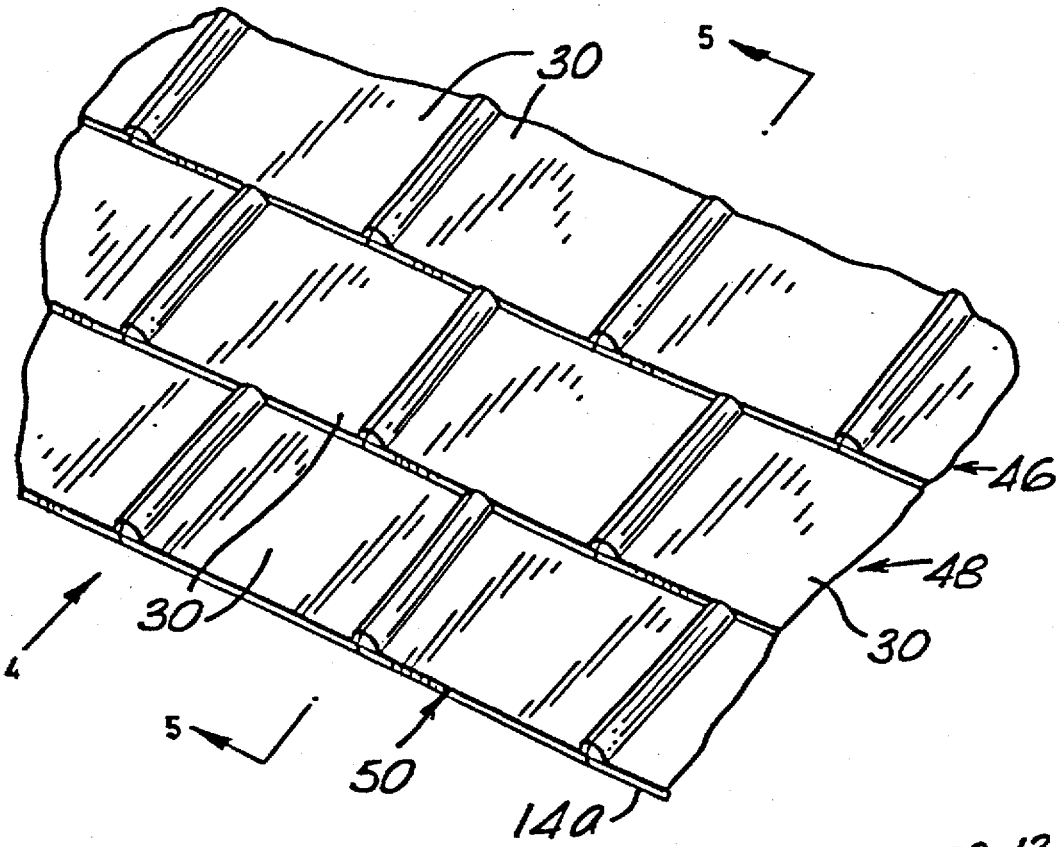
FIG. 3 is a perspective view of a roof surface comprising a plurality of roof tiles as in FIG. 2.

FIG. 3 shows a number of tiles 30 laid in broken bond on a roof surface. As can be seen, the tiles 30 are laid side by side such that along the same row 46, 48, 50, the underlock on one side edge cooperates with the overlock of the adjacent tile on the opposite side edge. Furthermore, the vertical side edge of an arcuate projection on one tile aligns with a vertical side edge of the opposite arcuate projection on an adjacent tile thereby giving the impression of a continuous roll running from the upper edge (not visible) of the tile to the lower edge 14*a*.

Figure 4:
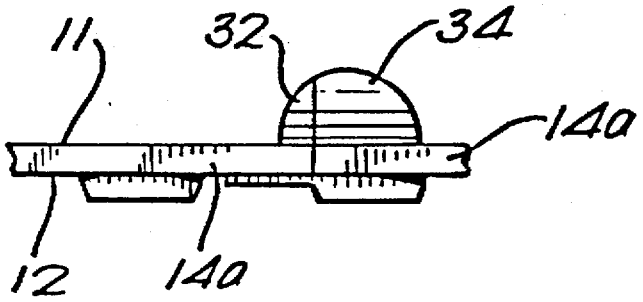
FIG. 4 is a front end view of the roof tile of FIG. 2 looking in the direction of the arrow 4 in FIG. 3.

FIG. 4 is a front-end view in the direction of arrow 4 of FIG. 3 and shows how the arcuate projections on adjacent tiles "sit" together (abut against each other) to give the appearance of a single projection in the form of a continuous roll.

Figure 5:
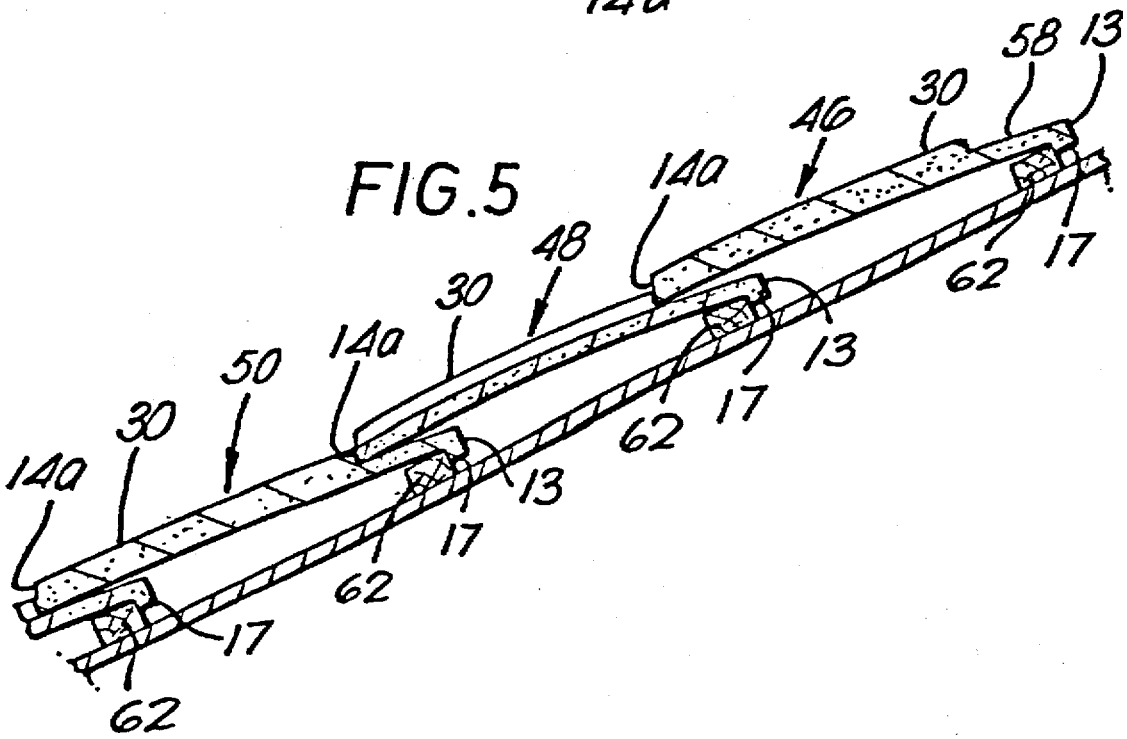
FIG. 5 is a cross-section taken along the line 5—5 of FIG. 3.
Figure 3A:
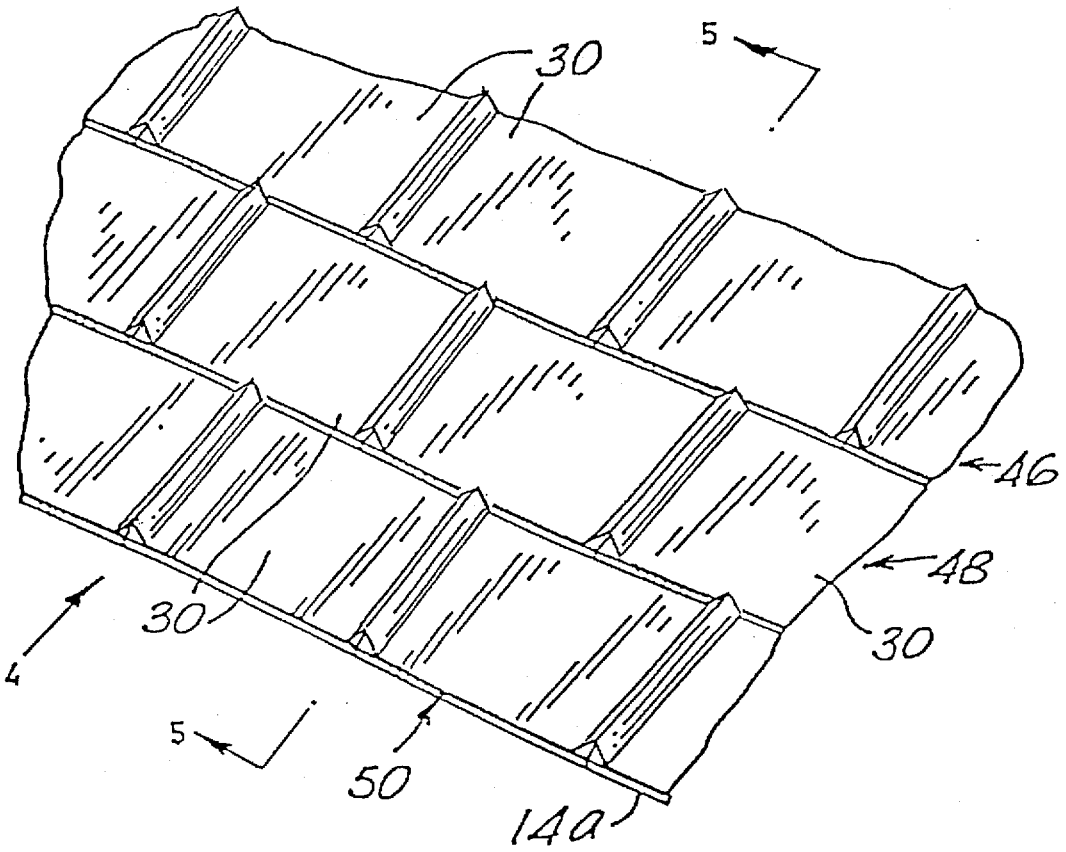
FIG. 3*a* is a perspective view of a roof surface comprising a plurality of roof tiles similar to that shown in FIG. 3, but wherein the roof tiles have abutting projections with a triangular cross-sectional shape.
Figure 6A:
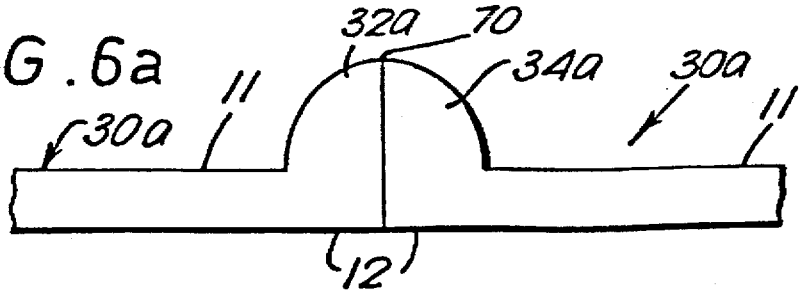
FIGS. 6*a*, 6*b*, 6*c*, 6*d*, 6*e* and 6*f* are diagrammatic end views of different profiles of a selection of profiles of tiles made in accordance with the invention, with two tiles in each drawing being shown in side by side relationship as if laid on a roof with two projections of the respective tiles being in abutment and with the tiles being partly shown only for purposes of clarity.
Figure 6B:
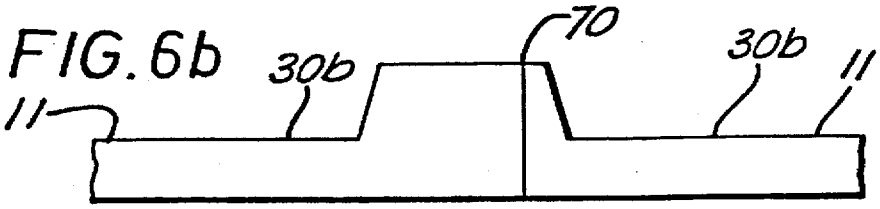
Figure 6C:
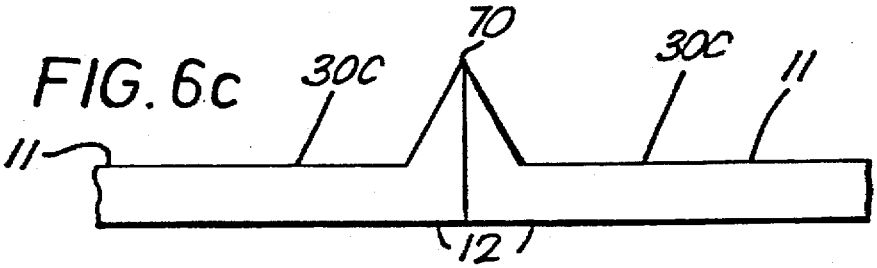
Figure 6D:
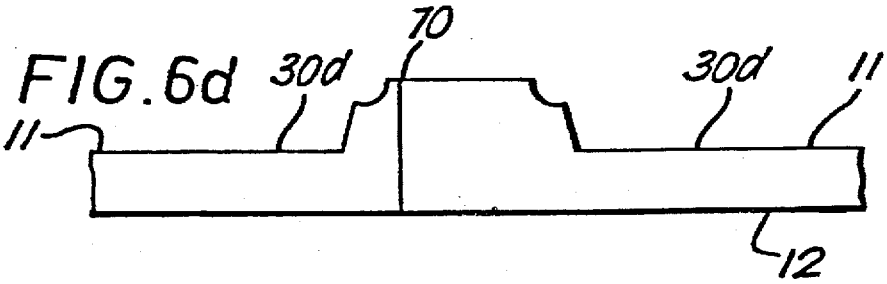
Figure 6E:
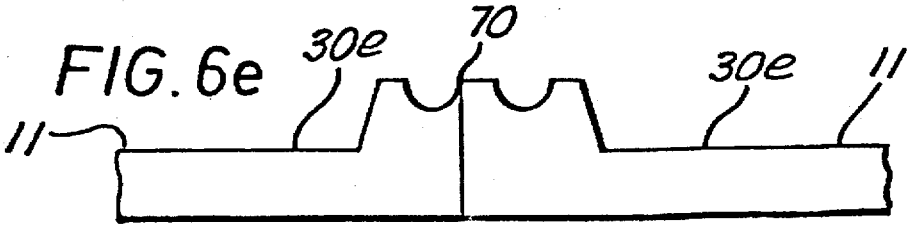
Figure 6F:
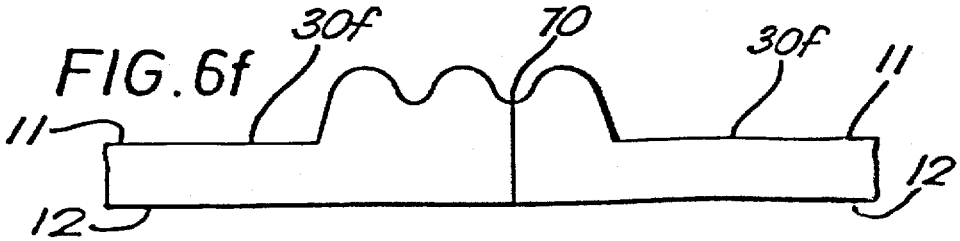

The cross-sectional view of FIG. 5 shows the lower edge 14*a* of each tile 30 overlapping at least part of the upper edge 13 of tile 30 in the row beneath. The projections 32, 34 on each tile do not extend into the overlap region 58 at the upper edge of the tile. Thus, in the overlap region 58, each tile 30 resembles the upper surface of a flat tile, thereby enabling the tiles to be laid in straight or broken bond patterns. The tile hanging nibs 17 locate each tile 30 on roof battens 62. FIG. 5 also illustrates the cambered upper and under surfaces of the tile extending from the upper edge to the lower edge.

Referring now to FIGS. 6*a* to 6*f*, the abutting arcuate projections 32*a*, 34*a* of tiles 30*a* are quadrants forming a continuous roll and are therefore symmetrical about the plane of abutment (split line) as are the projections 32*c*, 34*c* of tiles 30*c* which form a continuous triangular projection. The quadrant shaped projections provide for easier packaging of the tiles. On the other hand, in the tiles 30*b*, 30*d*, 30*e* and 30*f* shown in FIGS. 6*b*, 6*d*, 6*e* and 6*f*, respectively, the plane of abutment 70 is offset so that the split line is less visible from the ground. The split line can be offset in the tiles of FIGS. 6*b*, 6*d*, 6*e* and 6*f* without affecting their packaging capabilities in view of their generally rectangular shape.

While particular embodiments have been described, it should be appreciated that various modifications may be made without departing from the scope of the invention. For example, formations in the form of depressions may be provided in addition to, or instead of, the projections shown in the accompanying drawings. Although the preferred embodiment of tile described with reference to FIG. 2 has an under surface which is that of a slate, the under surface could be that of the plain tile shown in FIG. 1*b*, that of the shake shown in FIG. 1*d* or any other shape that enables the shape of the under surface to remain unchanged when the shape of the contoured upper surface is changed. The tiles described may be made from any suitable material which is capable of being extruded, such as a cementitious mixture, clay, or a polymer bound aggregate.

I claim:

1. In a roof tile comprising an upper edge, a lower edge and opposed side edges when in an orientation installed on a roof, the tile further comprising an under surface and a contoured upper surface which has a shape to give the appearance of a profiled tile, including a contoured portion and a portion which is not contoured, thereby to provide an undulating or otherwise non-planar roof surface, the improvement wherein the upper surface comprises an extrusion face, the tile has an overlap region extending from the upper edge toward the lower edge for a distance suitable to allow the upper edge of the tile to be overlapped by the lower edge of an upwardly adjacent roof tile, the contoured portion comprises at least one formation in the form of a projection which extends outwardly from the upper surface of the tile, the projection extending for a distance from the lower edge toward the upper edge for a distance as far as, but not into, the overlap region, and the under surface has a shape which generally corresponds to the shape of the portion of the upper surface of the tile that is not contoured.

2. In a roof tile comprising an upper edge, a lower edge and opposed side edges when in an orientation installed on a roof, the tile further comprising an under surface and a contoured upper surface which has a shape to give the appearance of a profiled tile, including a contoured portion and a generally flat portion, thereby to provide an undulating or otherwise non-planar roof surface, the improvement wherein the upper surface comprises an extrusion face, the tile has an overlap region extending from the upper edge toward the lower edge for a distance suitable to allow the upper edge of the tile to be overlapped by the lower edge of an upwardly adjacent roof tile, the contoured portion comprises at least one formation in the form of a projection which extends outwardly from the upper surface of the tile, the projection extending for a distance from the lower edge toward the upper edge for a distance as far as, but not into, the overlap region, and the under surface has a shape which generally corresponds to the shape of the generally flat portion.

3. A roof tile as claimed in claim 1 or 2, the tile being capable of being laid on a roof in both a straight bond pattern and in a broken bond pattern.

4. An extruded roof tile as claimed in claim 1 or 2, wherein the tile has two of the projections, each of the projections extending along opposed side edges, such that when two of the tiles are installed on a roof in a side-by-side lateral relationship, a projection along one side of a first tile abuts a projection on the laterally adjacent tile.

5. A roof tile as claimed in claim 1 or 2, wherein the under surface extends beyond the upper surface adjacent the lower edge thereby to provide a tapered lower edge.

6. A roof tile as claimed in claim 1 or 2, wherein the upper and under surfaces are cambered from the lower edge to the upper edge.

7. A pitched roof structure comprising a plurality of tiles of claim 1 or 2, the tiles being laid in side-by-side and overlapping lower edge over upper edge relationship over a support structure to form a roof, the tiles being laid in at least one of a straight bond pattern or a broken bond pattern.

8. A method of making extruded roof tiles each comprising an upper edge, a lower edge and opposed side edges when in an orientation installed on a roof, and having an under surface and a contoured upper surface, the upper surface having a shape to give the appearance of a profiled tile, including a contoured portion and a portion which is not contoured, thereby to provide an undulating or otherwise non-planar roof surface, the upper surface comprises an extrusion face wherein the tile has an overlap region extending from the upper edge toward the lower edge for a distance suitable to allow the upper edge of the tile to be overlapped by the lower edge of an upwardly adjacent roof tile, the contoured portion comprises at least one formation in the form of a projection which extends outwardly from the upper surface of the tile, the projection extending for a distance from the lower edge toward the upper edge for a distance as far as but not into, the overlap region, and the under surface has a shape which generally corresponds to the shape of the portion of the upper surface of the tile that is not contoured, the method comprising the steps:

(a) extruding a material from which the tiles are made onto a path which shapes the under surface of the tile;

(b) compressing the material on the path to provide the tiles with the contoured upper surface having the projection and with the under surface; and (c) removing a portion of the projection such that the projection does not extend into the overlap region.

9. A method of making extruded roof tiles each comprising an upper edge, a lower edge and opposed side edges when in an orientation installed on a roof, and having an under surface and a contoured upper surface, the upper surface having a shape to give the appearance of a profiled tile, including a contoured portion and a generally flat portion, thereby to provide an undulating or otherwise non-planar roof surface, the upper surface comprises an extrusion face, wherein the tile has an overlap region extending from the upper edge toward the lower edge for a distance suitable to allow the upper edge of the tile to be overlapped by the lower edge of an upwardly adjacent roof tile, the contoured portion comprises at least one formation in the form of a projection which extends outwardly from the upper surface of the tile, the projection extending for a distance from the lower edge toward the upper edge for a distance as far as, but not into the overlap region, and the under surface has a shape which generally corresponds to the shape of the generally flat portion, the method comprising the steps:

(a) extruding a material from which the tiles are made onto a path which shapes the under surface of the tile;

(b) compressing the material on the path to provide the tiles with the contoured upper surface having the projection and with the under surface; and (c) removing a portion of the projection such that the projection does not extend into the overlap region.

10. A method of making at least two series of extruded roof tiles, each tile comprising an upper edge, a lower edge and opposed side edges when in an orientation installed on a roof, and having an under surface and a contoured upper surface, the upper surface having a shape to give the appearance of a profiled tile, including a contoured portion and a portion which is not contoured, thereby to provide an undulating or otherwise non-planar roof surface, the upper surface comprises an extrusion face, wherein the tile has an overlap region extending from the upper edge toward the lower edge for a distance suitable to allow the upper edge of the tile to be overlapped by the lower edge of an upwardly adjacent roof tile, the contoured portion comprises at least one formation in the form of a projection which extends outwardly from the upper surface of the tile, the projection extending for a distance from the lower edge toward the upper edge for a distance as far as, but not into, the overlap region, each series of tiles having a different upper surface shape, and wherein the under surface of all series has a shape which generally corresponds to the shape of the portion of the upper surface of the tile that is not contoured, the under surface of the tiles of all series having substantially the same shape, the method comprising the steps:

(a) extruding a material from which the tiles are made onto a path which shapes the under surface of the tiles; and (b) compressing the material on the path to provide each series of tiles with a different contoured upper surface having a different projection without changing the under surface shaped on the path; and (c) removing a portion of the projection from each series such that the projection does not extend into the overlap region.

11. A method of making at least two series of extruded roof tiles, each tile comprising an upper edge, a lower edge and opposed side edges when in an orientation installed on a roof, and having an under surface and a contoured upper surface, the upper surface having a shape to give the appearance of a profiled tile, including a contoured portion and a generally flat portion, thereby to provide an undulating or otherwise non-planar roof surface, the upper surface comprises an extrusion face, wherein the tile has an overlap region extending from the upper edge toward the lower edge for a distance suitable to allow the upper edge of the tile to be overlapped by the lower edge of an upwardly adjacent roof tile the contoured portion comprises at least one formation in the form of a projection which extends outwardly from the upper surface of the tile the projection extending for a distance from the lower edge toward the upper edge for a distance as far as, but not into, the overlap region, each series of tiles having a different upper surface shape, and wherein the under surface of all series has a shape which generally corresponds to the shape of the generally flat portion, the under surface of the tiles of all series having substantially the same shape, the method comprising the steps:

(a) extruding a material from which the tiles are made onto a path which shapes the under surface of the tiles;

(c) removing a portion of the projection from each series such that the projection does not extend into the overlap region.

12. A method as claimed in claim 10 or 11, wherein the path comprises a plurality of pallets supported by a conveyor, the method further comprising shaping the upper surface of each series with roller and slipper means having a different shape to form each series with a different contoured upper surface.

13. A method as claimed in claim 12, wherein the tiles of at least one series of tiles further comprise an overlap region extending from the upper edge toward the lower edge for a distance suitable to allow the lower edge of an upwardly adjacent roof tile to overlap the upper edge of the tiles, the upper surface of the tiles having a continuous projection from the upper surface, the projection extending for a distance from the lower edge to the overlap region, and the method further comprises forming a continuous projection along the upper surface of the tiles, and thereafter removing a portion of the continuous projection from the overlap region.

14. A method as claimed in claim 13, further comprising forming the continuous projection by extrusion and removing the portion of the continuous projection from the overlap region from the extruded material formed into the continuous projection.

15. A method as claimed in claim 13, further comprising removing the portion of the continuous projection from the overlap region as the tiles move along the path.

16. An extruded roof tile made according to the method of any one of claims 8, 9, 10 or 11.

* * * * *